US006459374B1

(12) United States Patent
Rand et al.

(10) Patent No.: US 6,459,374 B1
(45) **Date of Patent: *Oct. 1, 2002**

(54) ANTI-THEFT COMPUTER SECURITY SYSTEM

(75) Inventors: Richard Rand, East Northport; Joseph DeConinck, West Babylon; Dominick Dimonda, Seaford, all of NY (US)

(73) Assignee: Protex International Corp., Bohemia, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/929,498

(22) Filed: Aug. 14, 2001

Related U.S. Application Data

(63) Continuation-in-part of application No. 09/710,595, filed on Nov. 10, 2000, now Pat. No. 6,300,874, which is a continuation-in-part of application No. 09/438,648, filed on Nov. 12, 1999, now Pat. No. 6,147,603.

(51) Int. Cl.[7] ..... G08B 13/12
(52) U.S. Cl. ..... 340/568.2; 340/571; 340/568.4
(58) Field of Search ..... 340/568.1, 568.2, 340/571, 568.4, 568.3; 439/607, 610

(56) References Cited

U.S. PATENT DOCUMENTS 5,034,723 A 7/1991 Maman
5,142,269 A 8/1992 Mueller
5,434,558 A * 7/1995 Zeder ..... 340/568
5,725,386 A 3/1998 Davis et al.
5,725,395 A 3/1998 Lee
5,748,083 A * 5/1998 Rietkerk ..... 340/568
5,767,711 A 6/1998 Lamont
5,821,857 A 10/1998 Rand
5,821,868 A 10/1998 Kuhling
6,067,014 A 5/2000 Wilson
6,300,874 B1 * 10/2001 Rand ..... 340/568.2

* cited by examiner

*Primary Examiner*—Anh V La
(74) *Attorney, Agent, or Firm*—Collard & Roe, P.C.

(57) ABSTRACT

A computer anti-theft security system comprises a USB connector having a housing section and a connector connected to the housing section. A cable is connected to the connector and extends through the housing section. The connector inserts into a USB port of a computer or peripheral and the cable is then connected to a central alarm monitoring unit. A sensor and electro-mechanical switch are disposed within the housing and connected to the cable as well. If the USB connector is disconnected from the computer or peripheral, thus opening the switch, or if the cable is cut, an alarm sounds from the central alarm monitoring unit.

4 Claims, 2 Drawing Sheets

ANTI-THEFT COMPUTER SECURITY SYSTEM

This is a continuation-in-part of U.S. patent application Ser. No. 09/710,595, filed on Nov. 10, 2000, now U.S. Pat. No. 6,300,874, which is a continuation-in-part of U.S. Pat. No. 09/438,648, filed on Nov. 12, 1999, now U.S. Pat. No. 6,147,603.

BACKGROUND OF THE INVENTION

1. Field of the Invention

This invention relates to an anti-theft security system for computers using a universal serial bus port. In particular, the invention relates to a sensor integrated with a universal serial bus connector that connects the computer or peripheral with a central alarm system, so that if the connecting cable is cut or damaged, or the connector is disconnected, an alarm is triggered at the central alarm system.

2. The Prior Art

Computers in large business establishments, and especially those on display in electronics stores, are highly prone to theft. Therefore, many computers are manually locked to the workstations or display shelves with a bicycle-type lock to prevent theft. These locks, however strong, can often be broken and the computer then stolen, with no detection. Large work spaces or retail computer stores can have large numbers of computers in one small area, and would thus be at a great loss if the computers were stolen.

SUMMARY OF THE INVENTION

It is therefore an object of the invention to provide an anti-theft security system for computers that immediately alerts the owner if theft or tampering occurs.

It is another object of the invention to provide an anti-theft security system for computers that also prevents theft of peripherals such as scanners, printers and other machines.

It is yet another object of the invention to provide an anti-theft security system that can protect large numbers of computers and peripherals with a single central alarm unit.

It is a further object of the invention to provide an anti-theft security system that can be used on any brand of computer or peripheral having a universal serial bus port.

These and other objects of the invention are accomplished by a computer anti-theft security system comprising a USB connector having a housing section and a connector connected to the housing section. A cable is connected to the connector and extends through the housing section. The connector inserts into a USB port of a computer or peripheral and the cable is then connected to a central alarm monitoring unit. A sensor is disposed within the housing and connected to the cable as well. If the USB connector is disconnected from the computer or peripheral, or if the cable is cut, an alarm sounds from the central alarm monitoring unit. The USB connector is built like a standard USB connector, such as disclosed in U.S. Pat. No. 5,725,395 to Lee or U.S. Pat. No. 5,725,386 to Davis et al, both of which are herein incorporated by reference.

The central alarm monitoring unit is preferably that disclosed in U.S. Pat. No. 5,821,857 to Rand, the disclosure of which is herein incorporated by reference. Many USB connectors with sensors can be connected to a single central alarm monitoring unit, so that an entire store or office full of computers and peripherals can be protected with a single alarm unit.

USB connectors are divided into two types: Type "A" and type "B". Type A connectors are oriented upstream toward the host system, i.e., connected to the computer. Type "B" connectors are oriented downstream of the host system, i.e., connected to the peripheral. The system according to the invention can use either type A or type B connectors, or both.

The USB connector is dimensioned and configured to fit commercially available computers and peripherals. The connector portion has a data+ and a data− terminal, which are connected to ground through a 15 kΩ resistor within the computer or peripheral. The general specifications for the connector portion and the dimensions of the USB connector according to the invention are well known in the art and are also disclosed in Universal Serial Bus Specification Revision 1.1, Chapter 6, pages 73–105, Sep. 23, 1998, available at www.usb.org/developers/data the disclosure of which is herein incorporated by reference.

The cable is preferably a four conductor cable. The sensor within the USB connector according to the invention includes a light emitting diode (LED) connected to two wires in the cable. The LED is preferably bicolor and glows one color, i.e., green, when the connector is connected to a computer or peripheral and to the central alarm unit. The LED glows red when the connector is disconnected in any way, indicating an alarm status. There is an electro-mechanical switch (EMS) that is activated to control the LED.

The sensor also includes a diode connected to the other two wires within the cable and to the computer or peripheral through the connector. The diode serves to indicate the presence of the sensor to the central alarm monitoring unit when the switch is open. The sensor works as follows: When the USB sensor is initially connected to the central alarm monitoring unit, the LED glows red, since the central alarm monitoring unit detects the presence of the sensor. Upon plugging the connector into the computer or peripheral, the electro-mechanical switch (EMS) is activated. The EMS sends a signal to illuminate the LED green, and alert the central alarm monitoring unit of a sensor condition. If the EMS is not activated, the circuit sends a signal to illuminate the LED red. Therefore, if the central alarm monitoring unit does not detect the return signal, either the connector is dislodged or the cable is broken. In either case, the central alarm monitoring unit will register an alarm and the LED on the sensor will switch from green to red.

The system according to the invention can be manufactured to be "supervised" or "non-supervised". In the supervised configuration, the system is constantly monitoring the sensor. If someone attempts to bypass, short, sever or tamper with the EMS or cabling, this will interrupt the current running through the system and thus tamper with the system, the sensor will detect this interference through registering a change in the voltage, and sound the alarm. In the non-supervised configuration, the alarm will sound only if the connection to the control unit is severed or if the EMS is deactivated.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
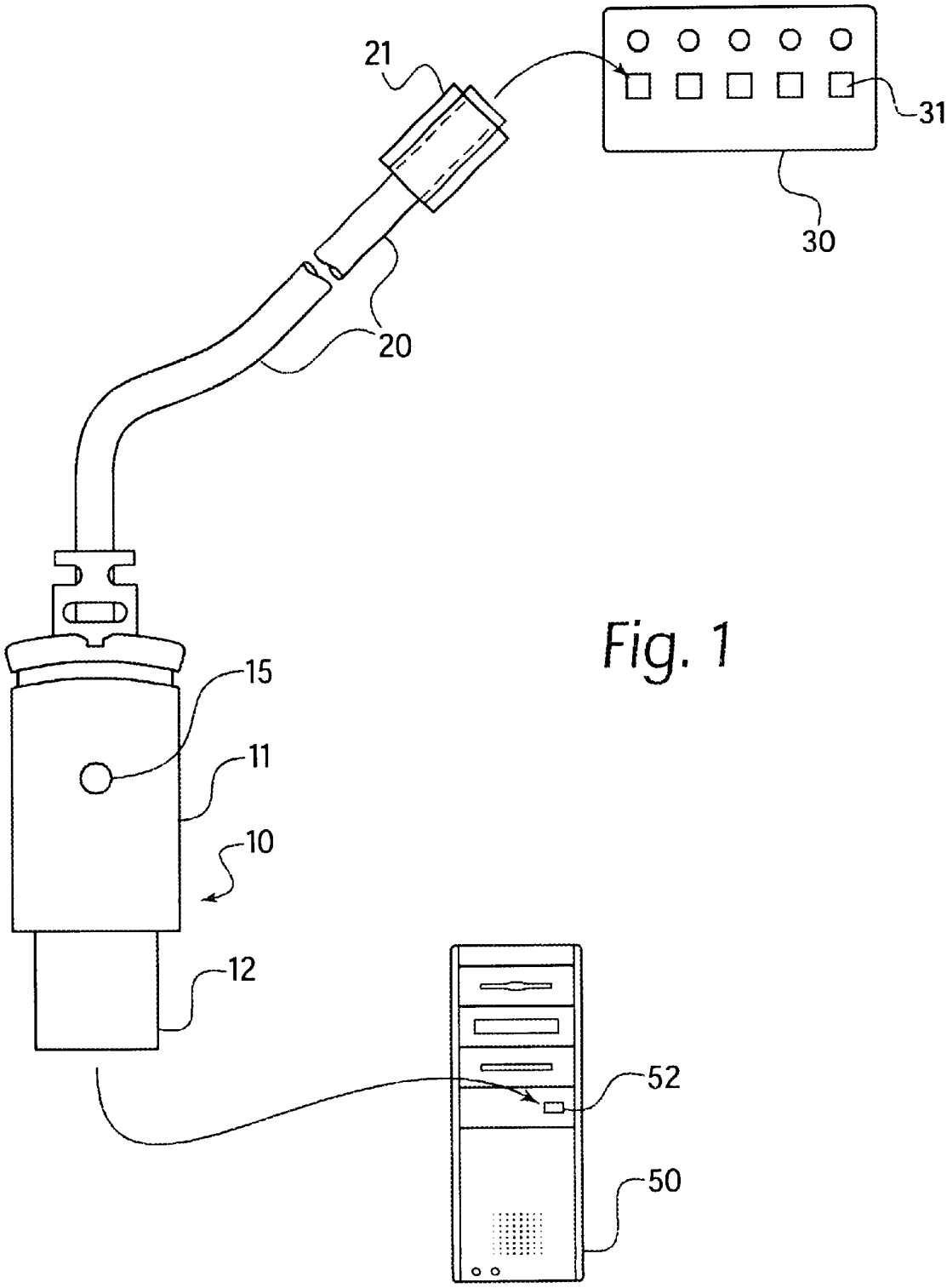
FIG. 1 shows an exploded schematic view of the system according to the invention.

Referring now in detail to the drawings, FIG. 1 shows an exploded view of the anti-theft computer security system according to the invention. The system comprises a USB connector 10 connected to a cable 20. Cable 20 is connected via connector 21 to a port 31 of central alarm monitoring unit 30. USB connector 10 plugs into a USB port of a computer 50 or a peripheral such as a printer or scanner (not shown).

As shown in FIG. 1, USB connector 10 is comprised of a housing 11, a connector 12 and a sensor having an LED 15 that extends through housing 11. LED 15 is preferably a bi-color LED that glows green when USB connector 10 is connected to the central alarm monitoring unit 30 and to a computer 50 or other peripheral, and glows red when cable 20 is cut or USB connector 10 is disconnected from computer 50. USB connector 10 is configured as a standard USB connector that is adapted to fit USB ports on commercially available computers and peripherals. USB connector 10 could be either a type A connector, i.e., for a computer, or a type B connector, i.e., for a peripheral.

Figure 2:
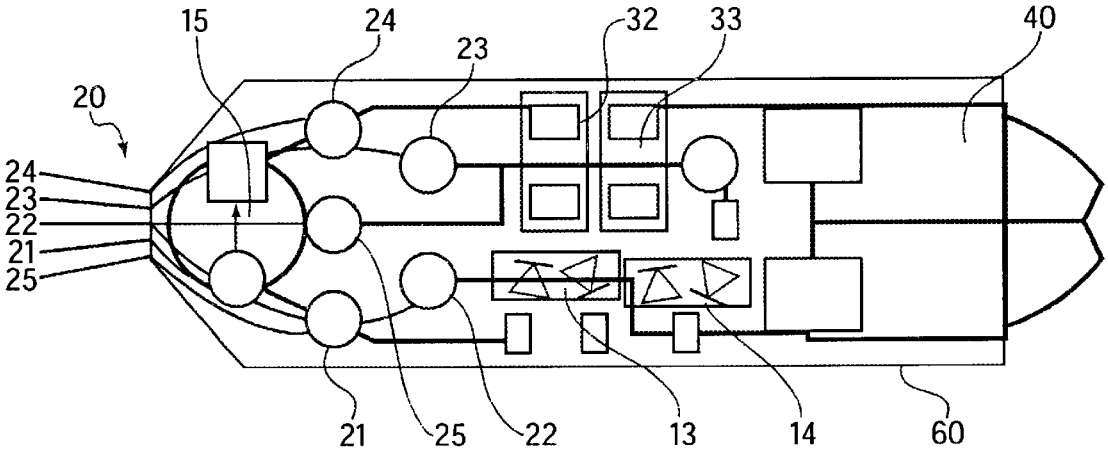
FIG. 2 shows an electronic diagram of the components of the USB connector according to the invention.
Figure 3:
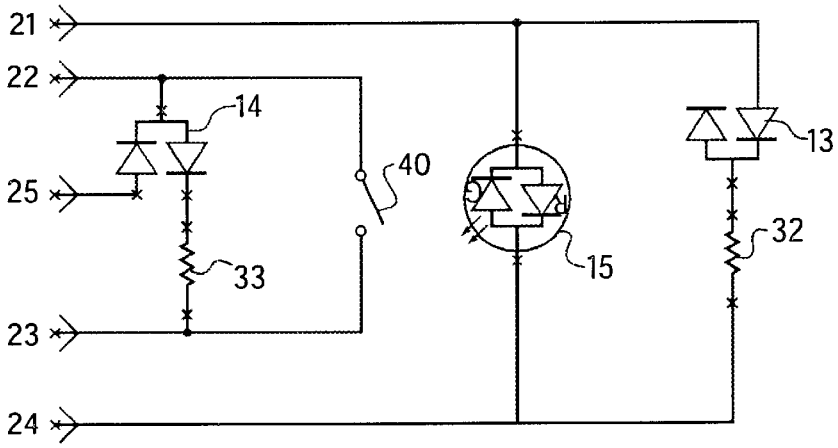
FIG. 3 shows a schematic internal view of the USB connector according to the invention.

FIGS. 2 and 3 show the internal components of USB connector 10. These components are mounted on a PC board 60. Cable 20 is comprised of four wires, 21, 22 or 25, 23 and 24. Wires 21 and 24, the yellow and black wires, respectively, are connected to LED 15 to illuminate LED 15. In the supervised version, wires 21 and 24 are also used to detect the presence of the sensor. Wire 23 is a red wire and is connected to diode 14 and switch 40 and is used in conjunction with either wire 22 or 25 to detect the status of switch 40 and to sense an alarm condition. Either wire 22 or wire 25 are used in the system, not both, depending on whether the system is set up to be non-supervised or supervised. In a non-supervised configuration, wire 22 (green) is used in conjunction with diode 14 and 0 Ω resistor 33 to detect the presence of the sensor when the switch is open. In a supervised configuration, wire 25 is used in conjunction with diode 14, diode 13 and 10 KΩ resistor 32 to detect the status of the switch and sense an alarm condition. A series connection of diode 13 and resistor 32 are wired in parallel with LED 15. An alarm condition is sensed when the switch is opened, the wire is cut, or the switch is tampered with in an attempt to bypass the switch and short the line. The changes in voltage during attempted tampering are registered to send an alarm condition to central monitoring unit 30. Diode 13 and resistor 32 are not functioning in the non-supervised configuration.

The USB connector is manufactured so that it can be used in either the supervised or unsupervised configuration. When the supervised configuration is desired, the green wire is connected as wire 25. When the unsupervised configuration is desired, the green wire is connected as wire 22.

In use, connector 12 of connector 10 is plugged into a USB port 52 of computer 50. This causes switch 40 to close and activate LED 15. Connector 21 of cable 20 is connected via port 31 to central alarm monitoring unit 30.

If cable 20 is cut, or if connector 10 is disconnected from computer 50, thus releasing switch 40, the central alarm monitoring unit 30 does not detect a return signal from the current through USB connector 10 and an alarm status is indicated. As stated above, if the supervised configuration is used, an alarm status is also indicated if any attempts are made to bypass switch 40 and short the line.

Several computers and several USB connectors according to the invention can be connected to a single central alarm monitoring unit.

Accordingly, while only a single embodiment of the present invention has been shown and described, it is obvious that many changes and modifications may be made thereunto without departing from the spirit and scope of the invention.

What is claimed is:

1. An anti-theft computer security system for securing electronic devices, comprising:

a USB connector comprising:

(a) a housing;

(b) a connector extending from the housing for connecting to a USB port on an electronic device;

(c) a sensor disposed within the housing and comprising a diode;

(d) an electromechanical switch connected to the diode, said switch closing when said connector is connected to a USB port on the electronic devices being secured;

a cable comprising a plurality of wires connected to the sensor and connector at one end and having a free end; and a central alarm monitoring unit connected to the free end of the cable, wherein the sensor is connected to two wires in the cable and to said switch, such that a circuit is completed when the connector is connected to an electronic device through a USB port, which closes the switch, and wherein the switch is opened when the connector is disconnected or the wire is cut, and wherein said central alarm monitoring unit detects the presence of the sensor and sends an alarm signal when the connector is disconnected from the electronic device or the cable is cut.

2. The system according to claim 1, wherein the cable has four wires and wherein said sensor further comprises a bi-color LED connected to two of the wires, said LED glowing one color when the switch is closed and the connector is connected to an electronic device and to the central alarm monitoring unit, and glowing another color when the switch is opened via the connector being disconnected from the electronic device.

3. The system according to claim 2, further comprising an additional diode, wherein a series connection of said additional diode and a resistor is connected in parallel with the LED, wherein said sensor detects an operating condition of said LED when said switch is bypassed.

4. The system according to claim 1, wherein said sensor and said switch are mounted on a PC board.

* * * * *